US005831377A

United States Patent [19]

Matsubara et al.

[11] Patent Number: 5,831,377

[45] Date of Patent: Nov. 3, 1998

[54] SPARK PLUG IN USE FOR AN INTERNAL COMBUSTION ENGINE

[75] Inventors: Yoshihiro Matsubara; Iwao Kunitomo; Wataru Matsutani, all of Nagoya, Japan

[73] Assignee: NGK Spark Plug Co, Ltd., Nagoya, Japan

[21] Appl. No.: 800,019

[22] Filed: Feb. 13, 1997

[30] Foreign Application Priority Data

Feb. 15, 1996 [JP] Japan ..... 8-027596
Feb. 6, 1997 [JP] Japan ..... 9-024181

[51] Int. Cl.[6] ..... H01T 13/20; H01T 13/00; F02M 57/06; F02P 13/00

[52] U.S. Cl. ..... 313/141; 313/118; 313/142; 313/143

[58] Field of Search ..... 313/118, 130, 313/131 R, 131 A, 137, 141, 142, 143, 144; 445/7

[56] References Cited

U.S. PATENT DOCUMENTS 4,122,366 10/1978 von Stutterheim et al. ..... 313/142
4,845,400 7/1989 Takamura et al. ..... 313/142
5,101,135 3/1992 Oshima ..... 313/142
5,159,232 10/1992 Sato et al. ..... 313/142
5,196,760 3/1993 Takamura et al. ..... 313/142
5,239,225 8/1993 Moriya et al. ..... 313/141
5,581,145 12/1996 Kato et al. ..... 313/141

FOREIGN PATENT DOCUMENTS 02 033879 4/1990 Japan .

*Primary Examiner*—Sandra L. O'Shea
*Assistant Examiner*—Mack Haynes
*Attorney, Agent, or Firm*—Sughrue, Mion, Zinn, Macpeak & Seas, PLLC

[57] ABSTRACT

In a spark plug including a cylindrical metal shell whose inner wall has a ledge portion, an insulator having a seat portion which engages with a rear slope surface of the ledge portion to be supported within the metal shell, a center electrode supported with an axial bore of the insulator, and a ground electrode extended from the metal shell to form a spark gap with the center electrode. A dimensional relationship among (A), (B) and (g) is defined as follows: $\{(B-A)/2\} \geqq 0.8\times(g)$ or $\{(B-A)/2\} \geqq 0.9\times(g)$. Where B (mm) is an inner diameter of a metal shell portion which surrounds an insulator nose, A (mm) is a base diameter of the insulator nose, and g (mm) is a width dimension of the spark gap.

18 Claims, 11 Drawing Sheets

SPARK PLUG IN USE FOR AN INTERNAL COMBUSTION ENGINE

BACKGROUND OF THE INVENTION

1. Field of the Invention

The invention relates to a spark plug which is to be mounted on an internal combustion engine, and particularly relates to a spark plug improved to prevent flashover discharges from jumping between an insulator nose and an inner wall of a metal shell when a high voltage is applied across electrodes at the time of ignition.

2. Description of Prior Art

In general, as shown in FIGS. 8, 9 and 10, a spark plug S (T, U) has a cylindrical metal shell 1 whose inner wall has a ledge portion 11. An insulator 2 has a seat portion 23 which engages with a rear slope surface 111 of the ledge portion 11 to be supported within the metal shell 1. A center electrode 3 is supported within an axial bore of the insulator 2. A ground electrode 4 extends from the metal shell 1 to form a spark gap (g) with the center electrode 3.

From the reason that the ledge portion 11 extends to receive the seat portion 23 of the insulator 2, there is likelihood of a potential voltage being reduced between an insulator nose 25 and the inner wall of the metal shell 1, thus inducing unfavorable discharges jumping therebetween when a high voltage is applied across the electrodes 3, 4 at the time of ignition.

In particular when running an engine for an extended period of time at traffic congestion in winter season, carbon deposit smolders the insulator nose 25 to permit a high voltage leak through the carbon deposit so as to jump spark discharges (referred to as "flashover" hereinafter) from the insulator nose 25 to the inner wall of a metal shell 1.

The flashover renders it impossible to normally induce spark discharges across the spark gap (g), thus causing an engine to stall with unstable idling. The flashover eventually causes to retard starting the engine at low temperatures with insufficient acceleration. In order to solve these problems, some countermeasures have been desired to be introduced.

The flashover often occurs when the spark gap is wider because it requires a high spark voltage due to the wider sprak gap.

Generally, an insulation resistance due to the carbon deposit reduces gradually for a longer nose compared to a shorter nose, however, once the insulation nose is carbon fouled to permit the flashover, it is unlikely to normally ignite an air-fuel mixture injected into a combustion chamber of an internal combustion engine.

Therefore, it is a main object of the invention to provide a spark plug which is capable of positively preventing the flashover from occurring between an insulator nose and an inner wall of a metal shell.

SUMMARY OF THE INVENTION

According to the present invention, a dimensional relationship among (A), (B) and (g) is defined as follows: $\{(B-A)/2\} \geqq 0.8\times(g)$ or $\{(B-A)/2\} \geqq 0.9\times(g)$. Where B (mm) is an inner diameter of a metal shell portion which surrounds an insulator nose, A (mm) is a base diameter of the insulator nose, and g (mm) is a width dimension of the spark gap.

With the dimensional relationship thus defined among (A), (B) and (g), it is possible to lengthen a distance between an outer surface of the insulator nose and an inner wall of a metal shell, and thereby elevating a voltage required to induce the flashover. This is particularly remarkable when the formula satisfies the relationship of $\{(B-A)/2\} \geqq 0.9\times(g)$. This makes it possible to effectively avoid the flashover when the insulator nose is carbon fouled, and thereby positively inducing spark discharges across the spark gap to avoid an engine from stalling with stable idling while maintaining a smooth starting of the engine at low temperatures with good accelaration.

While ignitablity is improved due to flame-extinguishing effect with the increase of the spark gap (more than 1.0 mm, preferably 1.3 mm) when ignitable air-fuel ratio is more than 16, it is necessary to apply higher voltage across electrodes as the spark gap increases. For this reason, the flashover is likely to occur immediately in front of the ledge portion when the carbon deposit on the insulator nose is such a degree that the insulation resistance is measured to be approx. 1000 MΩ with the use of a 1000-volt Megger.

However, with, the dimensional relationship of $\{(B-A)/2\} \geqq 0.8\times(g)$ or $\{(B-A)/2\} \geqq 0.9\times(g)$, it is possible to lengthen the insulation distance between the outer surface of the insulator nose and the inner wall of the metal shell, and thereby elevating the voltage required to induce the flashover when imparting a wider spark gap to a spark plug in which a high voltage is applied across the center electrode and the metal shell. This makes it possible to effectively avoid the flashover when the insulator nose is carbon fouled, and thereby avoiding an engine from stalling with stable idling while maintaining a smooth starting of the engine at low temperatures with good acceleration.

With the spark gap forming end of the center electrode sufficiently thinned, it is possible to reduce the voltage required to induce the spark discharge so as to effectively avoid the flashover when the insulator nose is carbon fouled. With the spark gap forming end made of a noble metal based metal, it is possible to impart a spark erosion resistant property to the electrode.

In general, the insulation resistance due to the carbon deposit lowers gradually for a longer nose (more than 12 mm) compared to a shorter nose, however, once the insulation nose is carbon fouled to permit the flashover, it is unlikely to normally ignite an air-fuel mixture injected into a combustion chamber of an internal combustion engine because the flashover occurs deep behind a front end of the insulator.

However, with the dimensional relationship of $\{(B-A)/2\} \geqq 0.8\times(g)$ or $\{(B-A)/2\} \geqq 0.9\times(g)$, it is possible to lengthen the distance between the outer surface of the insulator nose and the inner wall of the metal shell, and thereby elevating the voltage required to induce the flashover when the insulation nose is carbon fouled. This makes it possible to effectively avoid the flashover when the insulator nose is carbon fouled, and thereby avoiding an engine from stalling with stable idling while maintaining a smooth starting of the engine at low temperatures with good acceleration.

When the ledge portion of the metal shell is acutely cornered, corona discharges are likely to occur around the ledge portion of the metal shell. With at least one of the corners of the ledge portion rounded to have more than 0.2 (1/mm) in terms of curvature R, it is possible to reduce an electric field intensity around the ledge portion to prevent the corona discharges so as to effectively avoid the flashover when the insulator nose is carbon fouled, and thereby avoiding an engine from stalling with stable idling while maintaining a smooth starting of the engine at low temperatures with good acceleration.

DETAILED DESCRIPTION OF PREFERRED EMBODIMENTS OF THE INVENTION

Figure 1:
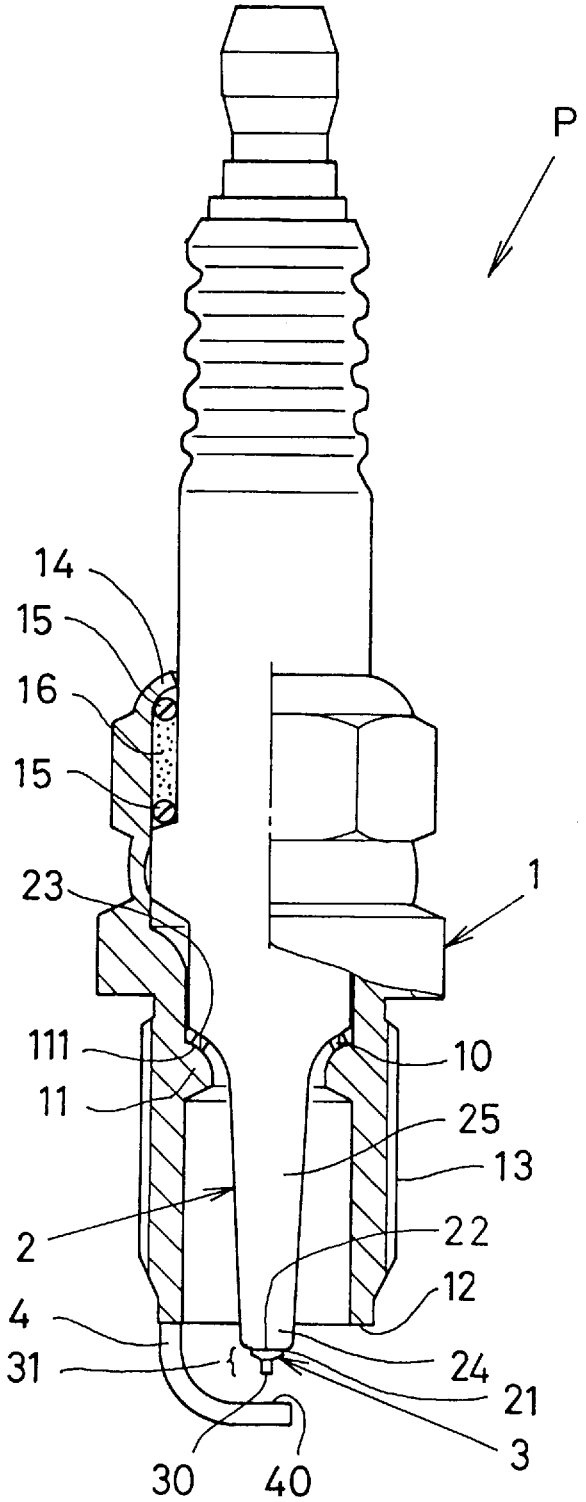
FIG. 1 is a partially sectioned plan view of a spark plug according to a first embodiment of the invention.

Referring to FIGS. 1~5 which show a parallel-electrode type spark plug according to a first embodiment of the present invention, the spark plug (P) has a cylindrical metal shell 1 whose inner wall has a ledge portion 11, and having an insulator 2 fixedly supported within the metal shell 1. An inner space of the insulator 2 serves as an axial bore 21. Within the axial bore 21, a center electrode 3 is fixedly provided to extend a front end 31 of the electrode 3 beyond a front end surface 22 of the insulator 2. From a front end surface 12 of the metal shell 1, a ground electrode 4 extends whose spark gap forming end 40 faces a spark gap forming end 30 of the center electrode 3. By way of a gasket, the spark plug (P) is to be mounted on a cylinder head of an internal combustion engine (each not shown).

The metal shell 1 is made of a low carbon steel whose outer surface has a male thread portion 13. An inner diameter (B) of the metal shell portion surrounding an insulator nose 25 is 8.7 mm while a rear corner of a rear slope surface 111 of the ledge portion 11 is rounded to have more than 0.3 (1/mm) in terms of curvature R.

The insulator 2 is made of a sintered ceramic body with alumina ($Al_2O_3$) as a main constituent. The insulator 2 has a seat portion 23 engaged with the rear slope surface 111 via a packing 10 while caulking a rear tail 14 of the metal shell 1 via an O-ring 15 and a sealant 16 to firmly place the insulator 2 with the metal shell 1 in the manner that the front end 24 of the insulator 2 extends beyond the front end surface 12 of the metal shell 1.

In this instance, the front end surface 22 of the insulator 2 measures 4.9 mm in diameter. A base diameter (A) of the insulator nose 25 measures 6.0 mm while a length (L) of the insulator nose 25 measures 17 mm. An extension length of the insulator nose 25 from the front end surface 12 of the metal shell 1 measures 1.5 mm.

Figure 2:
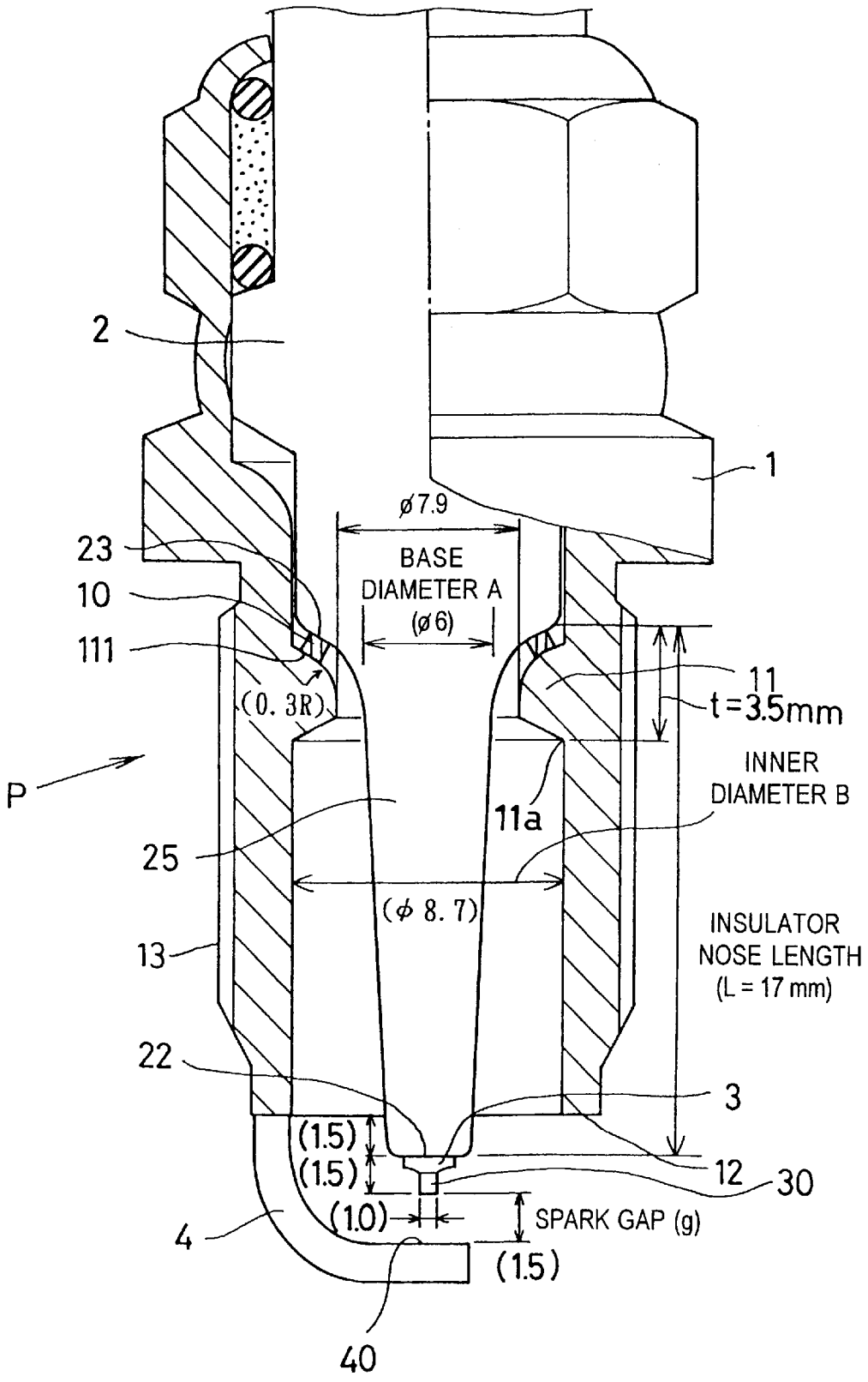
FIG. 2 is an enlarged longitudinal cross sectional view of a main section of the spark plug of FIG. 1.
Figure 2A:
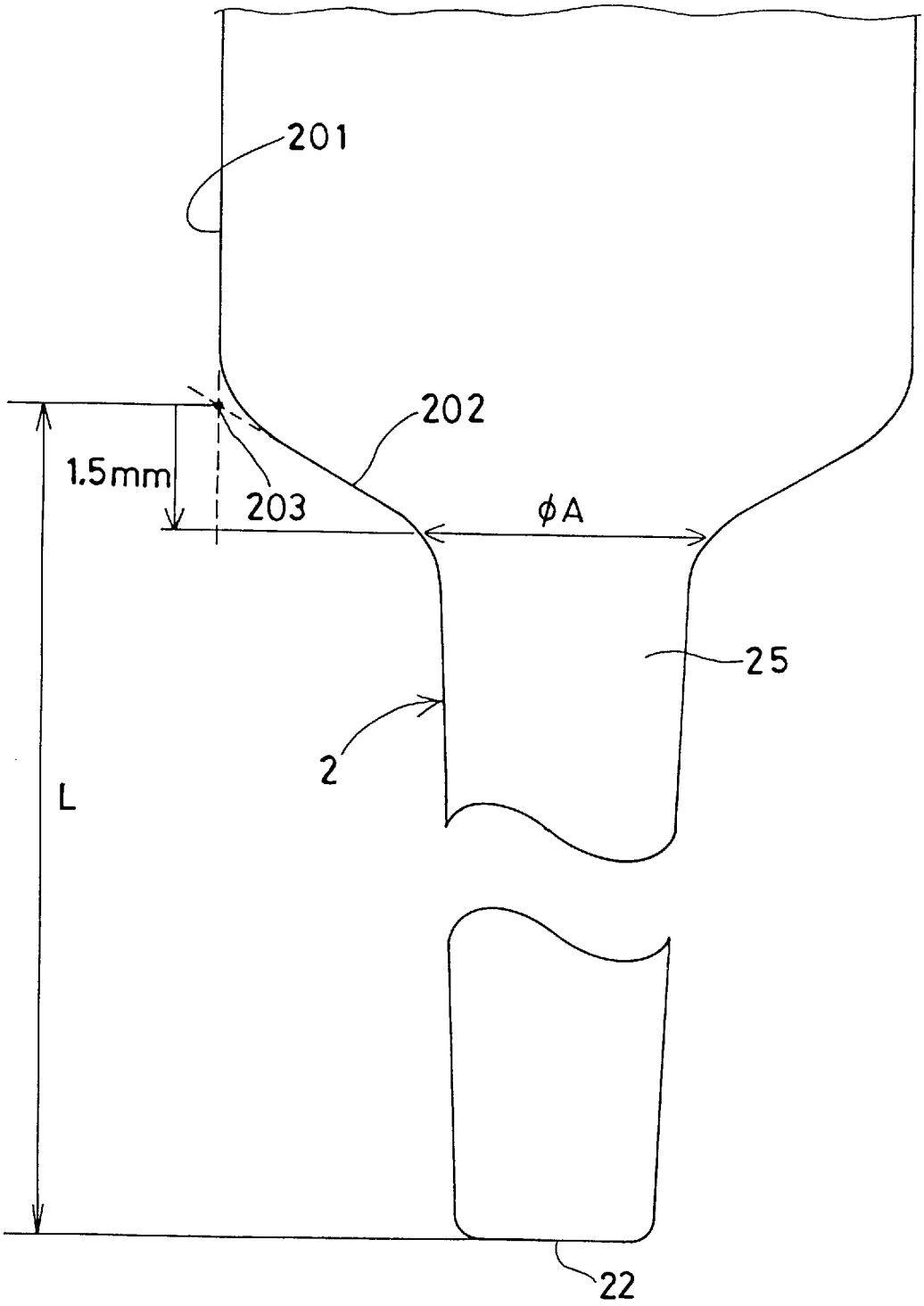
FIG. 2*a* is a schematic view of an insulator nose depicted how a base diameter (A) and an insulator nose are defined respectively.

It is to be observed from FIG. 2*a* that the base diameter (A) is located by extending by 1.5 mm forward from an intersection line 203 provided by lengthening lines along a barrel surface 201 and a basal taper surface 202 (seat portion 23) of the insulator 2 respectively. As understood by referring to FIG. 2 and FIG. 2*a,* the insulator nose 25 has a length (L) measured from the intersection line 203 to the front end surface 22 of the insulator 2. While an inner diameter of the annular ledge portion 11 is 7.9 mm, a length (t) from the intersection line 203 to a front root 11*a* of the ledge portion 11 measures 3.5 mm.

The center electrode 3 is made of a nickel based metal in which a heat-conductive copper or silver core is embedded. The spark gap forming end 30 of the center electrode 3 is thinned to reduce its diametrical dimension to e.g., 1.0 mm. In this instance, the extension length of the center lectrode 3 from the front end surface 22 of the insulator 2 is 1.5 mm, and a width of the spark gap (g) is 1.5 mm by way of illustration.

From the reason that an ionization effect works readily to reduce a voltage required to induce spark discharges when a pointed end is in a negative polarity, the center electrode 3 is arranged to be in the negative polarity against the metal shell 1 when a high voltage is applied across the electrodes 3, 4 at the time of ignition.

The ground electrode 4 is made of the nickel based metal, and generally formed into L-shaped configuration. The ground electrode 4 is resistance welded to the front end surface 12 of the metal shell 1 so that the spark gap forming end 40 faces the spark gap forming end 30 of the center electrode 3 via the spark gap (g).

A series of cold starting experimental tests (i)~(iii) were carried out with the spark plug mounted on a four-cylinder, 1600 cc engine in an experimental room at −25° C. While idling the engine for 15~30 seconds, the engine is raced ten times with the ten-time racing as a single cycle. After stopping the engine, the engine is cooled. Then, the number of cycles capable of re-starting the engine is checked by cranking the engine up. When unable to start the engine by cranking it up for 20 seconds, the engine is cranked up again after an elapse of 30 seconds. Even when unable to crank the engine up again after the elapse of 30 seconds, it is the case of failure to start the engine.

Figure 3:
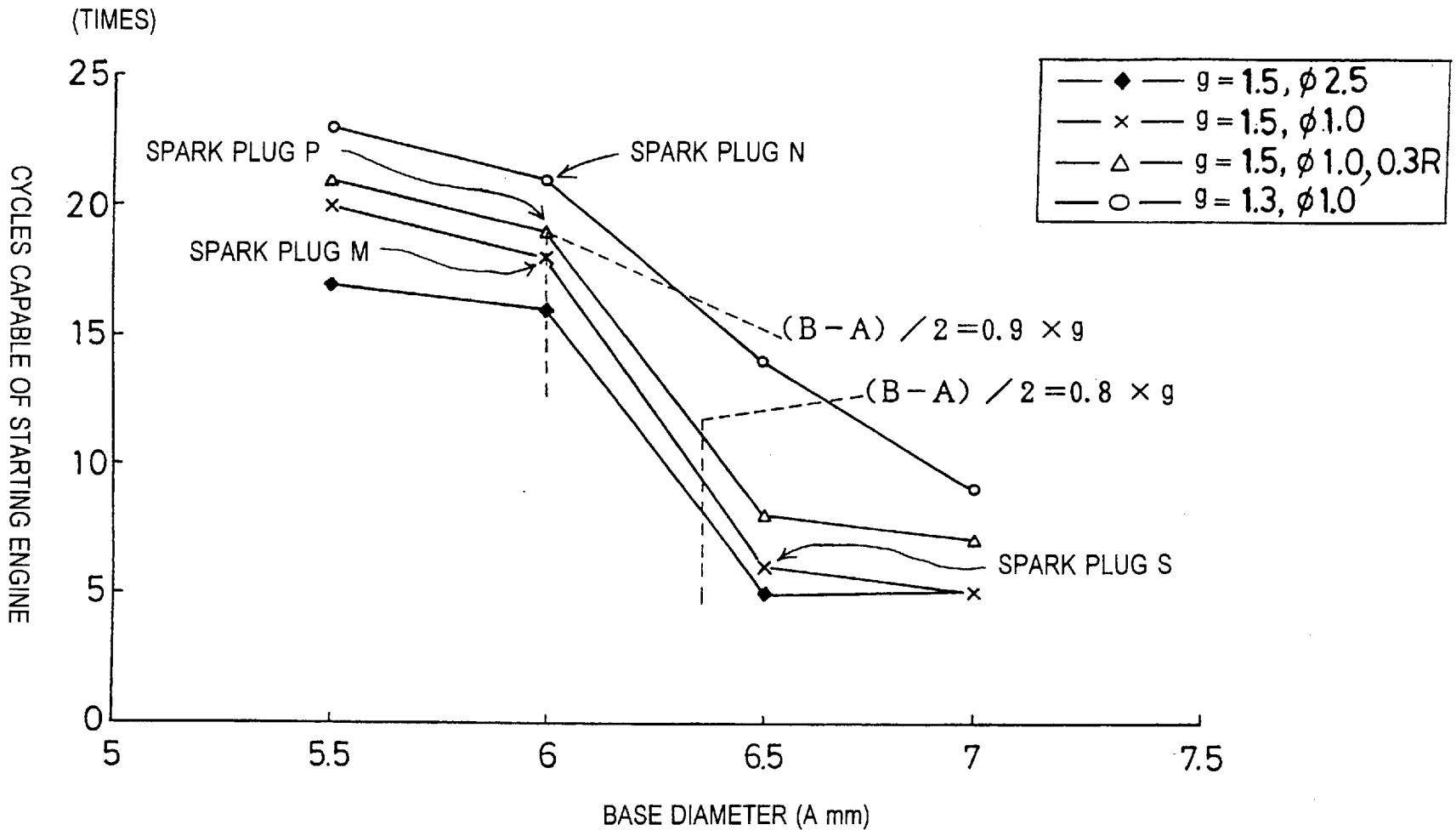
FIG. 3 is a graphical representation depicting experimental test results obtained by cold starting an engine.

(i) FIG. 3 shows a graphical representation depicting a dimensional relationship between the cold starting characteristics and the base diameter (A), the inner diameter (B) of the insulator nose 25 and the width dimension of the spark gap (g).

Figure 4:
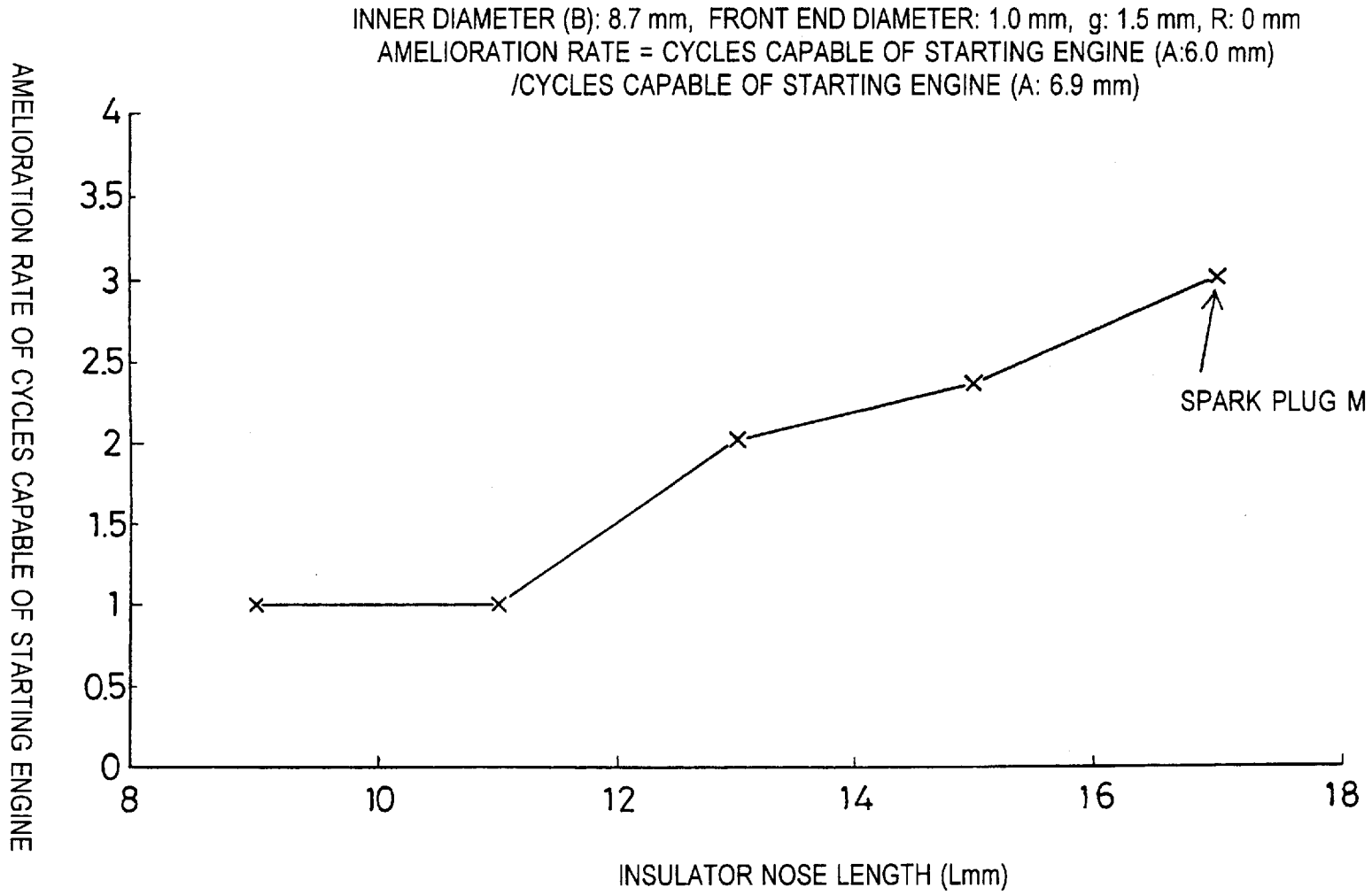
FIG. 4 is a graphical representation depicting a relationship between an insulator nose length and cycles capable of starting the engine.

(ii) FIG. 4 shows a graphical representation depicting a relationship between the length (L) of the insulator nose 25 and an amelioration rate of the cycles capable of starting the engine.

Figure 5:
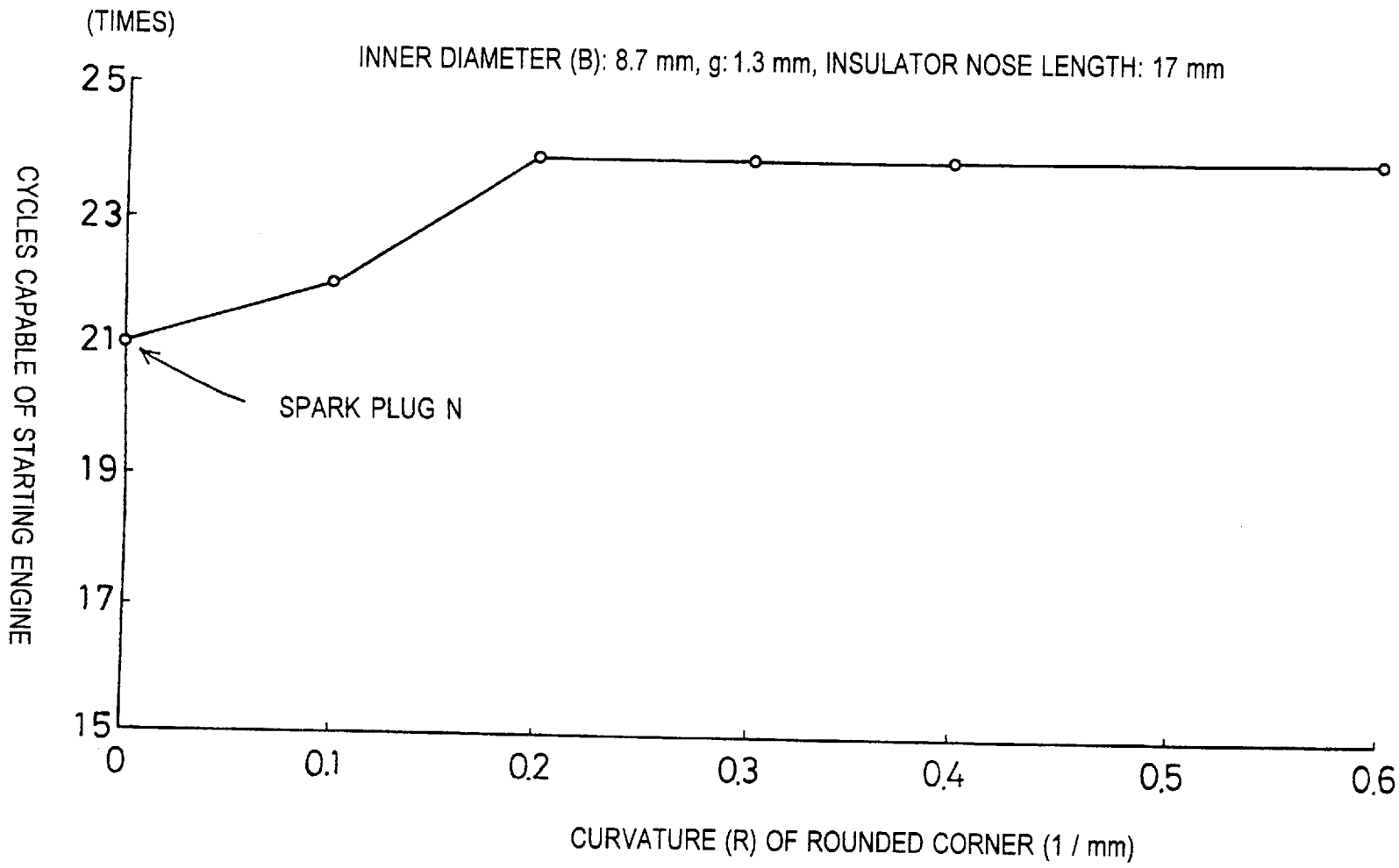
FIG. 5 is a graphical representation depicting a relationship between a curvature (R) of a corner of a ledge portion and an amelioration rate of cycles capable of starting the engine.

(iii) FIG. 5 shows a graphical representation depicting a relationship between the rear corner portion of the ledge portion 11 and the cycles capable of starting the engine.

In FIG. 3, a curve (-○-) depicts how the cold starting characteristics varies as the base diameter (A) changes to 5.5 mm, 6.0 mm, 6.5 mm and 7.0 mm. In this instance, the width dimension of the spark gap (g) and a diameter (ϕ) of the spark gap forming end 30 of the center electrode 3 are modified on the basis of the spark plug (P) to be in turn 1.3 mm and 1.0 mm with the rear corner of the ledge portion 11 not rounded. When a spark plug has the base diameter (A) of 6.0 mm, it is designated by notation N for the purpose of convenience.

Figure 8:
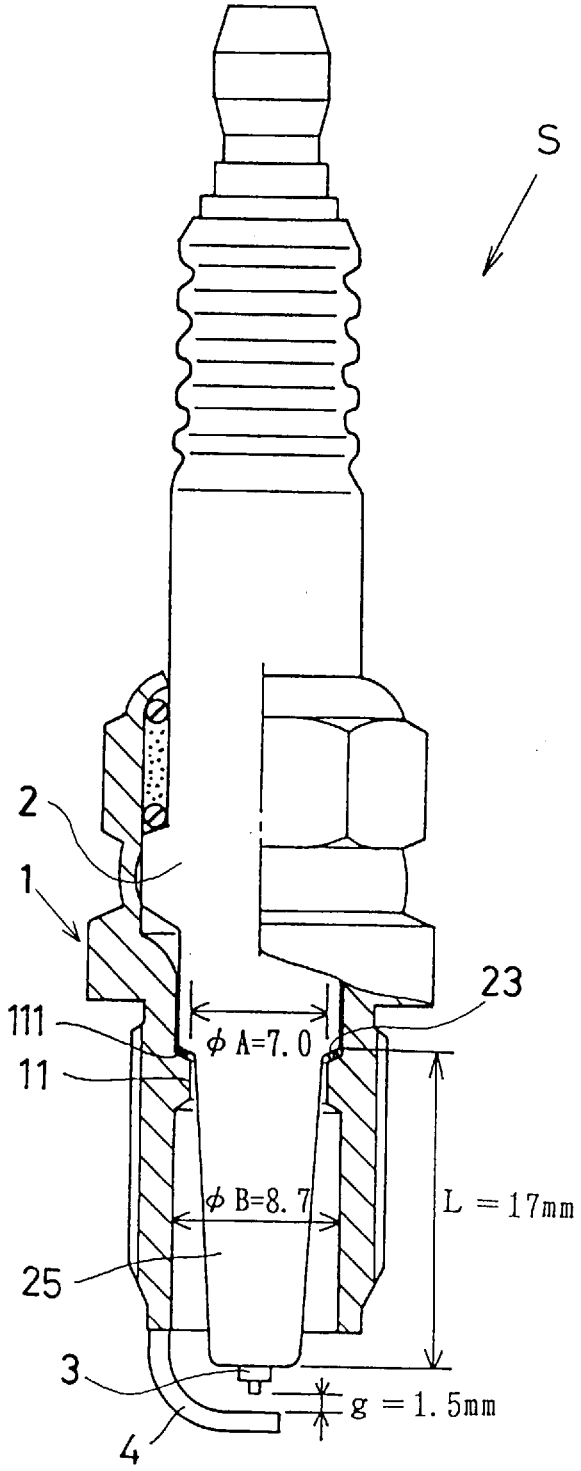
Fig. 8 Prior Art
FIG. 8 is a partially sectioned plan view of a prior spark plug.

In FIG. 3, a curve (-×-) depicts how the cold starting characteristics varies as the base diameter (A) changes to 5.5 mm, 6.0 mm, 6.5 mm and 7.0 mm respectively. In this instance, the width dimension of the spark gap (g) and the diameter (ϕ) of the spark gap forming end 30 of the center electrode 3 are modified on the basis of the spark plug (P) to be in turn 1.5 mm and 1.0 mm with the rear corner of the ledge portion 11 not rounded. When a spark plug has the base diameter (A) of 6.0 mm, it is designated by notation M for the purpose of convenience. When a spark plug has the base diameter (A) of 7.0 mm, it is represented by a prior counterpart S as shown in FIG. 8.

In FIG. 3, a curve (-Δ-) depicts how the cold starting characteristics varies as the base diameter (A) changes to 5.5 mm, 6.0 mm, 6.5 mm and 7.0 mm respectively. In this instance, the spark gap (g) and the diameter (ϕ) of the spark gap forming end 30 of the center electrode 3 are modified on the basis of the spark plug (P) to be in turn 1.5 mm and 1.0 mm with the rear corner of the ledge portion 11 rounded to have 0.3 (1/mm) in terms of curvature R.

In FIG. 3, a curve (-◆-) depicts how the cold starting characteristics varies as the base diameter (A) changes to 5.5 mm, 6.0 mm, 6.5 mm and 7.0 mm respectively. In this instance, the spark gap (g) and the diameter (ϕ) of the spark gap forming end 30 of the center electrode 3 are modified on the basis of the spark plug (P) to be in turn 1.5 mm and 2.5 mm with the rear corner of the ledge portion 11 not rounded.

In FIG. 4, a curve (-×-) depicts how the starting amelioration characteristics varies as the insulation nose length (L) changes to 9.0 mm, 11.0 mm, 13.0 mm, 15.0 mm and 17.0 mm respectively. In this instance, the spark gap (g) and the base diameter (A) are modified on the basis of the spark plug (P) to be in turn 1.5 mm and 6.0 mm with the rear corner of the ledge portion 11 not rounded. The amelioration rate is calculated on the basis of a comparative diameter (6.9 mm).

In FIG. 5, a curve (-○-) depicts how the starting characteristics varies as the curvature R changes to 0.0 mm, 0.1 mm, 0.2 mm, 0.3 mm 0.4 mm, and 0.6 mm respectively. In this instance, the spark gap (g) and the base diameter (A) are modified on the basis of the spark plug (P) to be in turn 1.3 mm and 6.0 mm.

[a] As understood from FIG. 3, it is found that the number of cycles capable of starting the engine has significantly increased with good cold starting characteristics by arranging a half clearance (B-A)/2} to be more than 0.8 times of the spark gap (g), preferably 0.9 times of the spark gap (g).

In case of the inner diameter (B) and the spark gap (g) being 8.7 mm and 1.5 mm based on the spark plug (P), the number of cycles capable of starting the engine has counted more than 11 times or 19 times without losing the good cold starting characteristics by arranging the base diameter (A) to be less than 6.3 mm or preferably 6.0 mm.

[b] In the wide gap type spark plug in which the spark gap (g) measures 1.3 mm or 1.5 mm, a higher voltage is required to induce the spark discharges, thus often inducing the flashover when the insulator nose 25 is carbon fouled.

However, with the half clearance arranged to be more than 0.8 times of the spark gap (g) or preferably 0.9 times of the spark gap (g), it is possible to avoid the unfavorable flashover with the good cold starting characteristics.

[c] As apparent by comparing the curve (-×-) to the curve (-Δ-) of FIG. 3 or from the curve (-○-) of FIG. 5, with the ledge portion 11 rounded to have more than 0.3 mm in terms of curvature R, it is possible to make an electric field intensity low around the ledge portion 11 so as to avoid the flashover, thus improving the good cold starting characteristics with the increased number of cycles capable of starting the engine.

[d] In the spark plug in which the base diameter (A) is determined to be 6.0 mm by satisfying that the half clearance is more than 0.9 times of the spark gap (g) as shown in FIG. 3, it is possible to insure good amelioration rate capable of starting the engine. It is also found that the amelioration rate is improved as the insulation nose length (L) is lengthened to be more than 12 mm as shown in FIG. 4.

[e] In the spark plug (P) and the equivalents in which the half clearance is more than 0.8 times of the spark gap (g) preferably 0.9 times of the spark gap (g), it was confirmed from other experimental test results that they could prevent the flashover when the insulation nose 25 was carbon fouled. In addition to the good cold starting characteristics which the present invention has achieved, it is possible to exibit a smooth starting of the engine with stable idling and acceleration.

Figure 6:
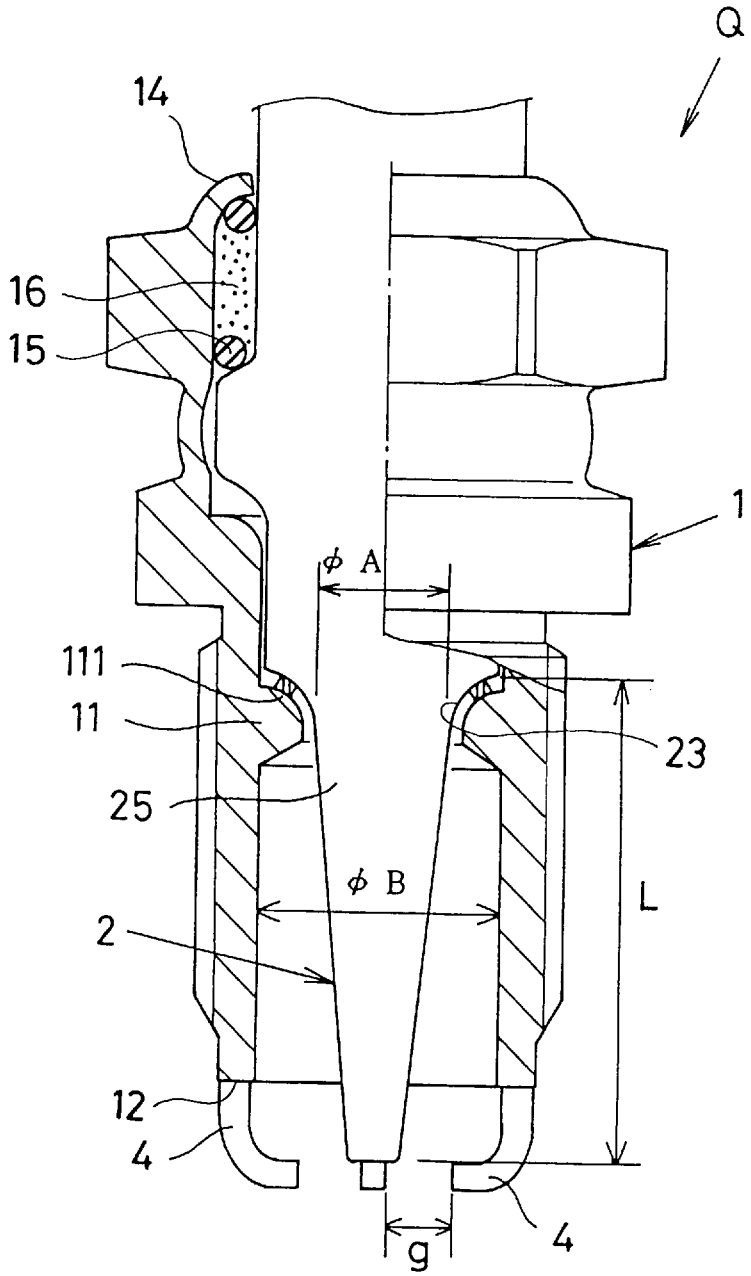
FIG. 6 is a partially sectioned plan view of a main portion of a dual-gap type spark plug according to a second embodiment of the invention.

FIG. 6 shows a second embodiment of the invention which a dual-gap type spark plug (Q) has a diametrically opposed ground electrodes 4, 4 are resistance welded to the front end surface 12 of the meta shell 1 so as to alleviate the spark erosion by 1.4~1.6 times.

The spark plug (Q) is an improved version of a prior dual-gap type spark plug (T) of FIG. 9 which is referred to hereinafter.

[Specification of Spark Plug (Q)]

In the spark plug (Q), the insulator nose length (L) measures 15 mm, and the inner diameter (B) measures 8.7 mm. The base diameter (A) and the width dimension of the spark gap (g) in turn measure 6.23 mm and 1.3 mm with the rear corner of the ledge portion 11 rounded to have 0.3 (1/mm) in terms of curvature R.

[Specification of Spark Plug (T)]

Figure 9:
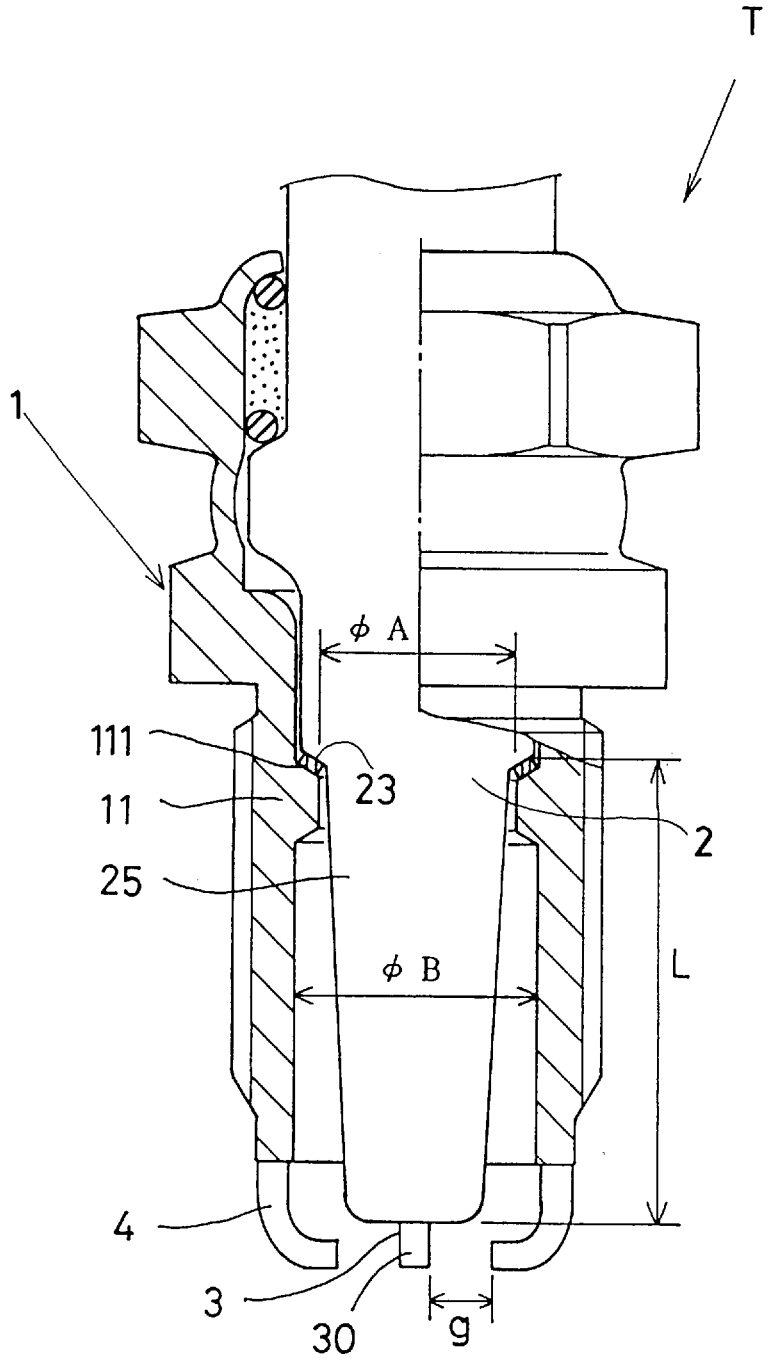
Fig. 9 Prior Art
FIG. 9 is a partially sectioned plan view of a main portion of a prior dual-gap type spark plug.

In the spark plug (T) of FIG. 9, the insulator nose length (L) measures 15 mm, and the inner diameter (B) measures 8.7 mm. The base diameter (A) and the spark gap (g) in turn measure 6.88 mm and 1.3 mm with the rear corner of the ledge portion 11 not rounded.

According to the second embodiment of the invention, the half clearance {(B-A)/2} is arranged to be 0.95 times of the spark gap (g), it is possible to substantially attain the same advantages as raised at [a]~[e].

Figure 7:
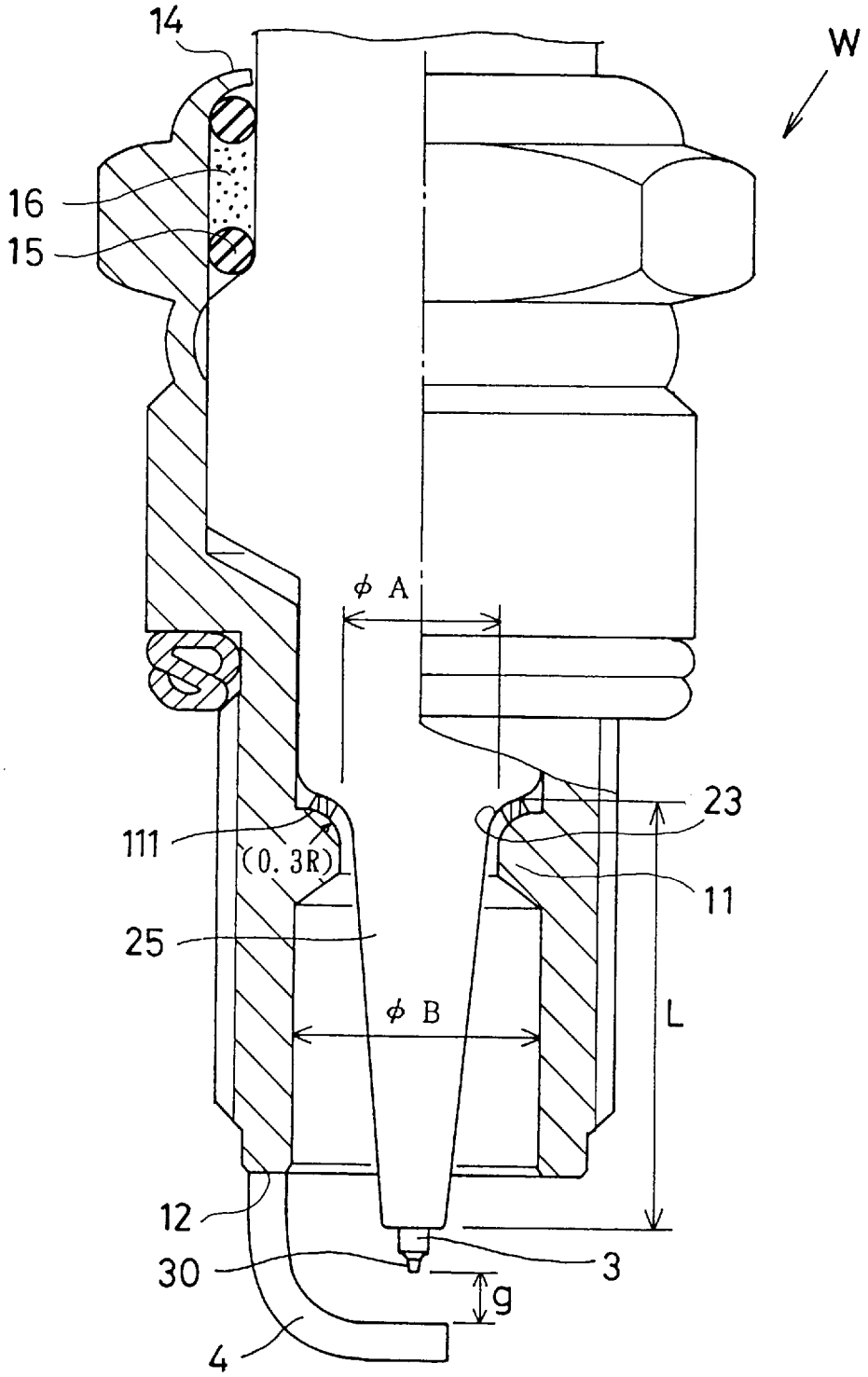
FIG. 7 is a partially sectioned plan view of a main portion of a spark plug according to a third embodiment of the invention.

FIG. 7 shows a third embodiment of the invention which a spark plug (W) has a wider spark gap, and the spark gap forming end 30 is thinned in order to improve the ignitability with minimum flame-extinguishing effect. The width dimension of the spark gap (g) is 1.3 mm, and the spark gap forming end 30 measures 0.9 mm in diameter. It is to be observed that the spark gap forming end 30 of the center electrode 3 is made of Pt—Ir alloy, Pt—Ni alloy, Pt—Ir—Ni alloy or the like in order to impart the spark erosion resistant property to the electrode 3.

The spark plug (W) is an improved version of a prior spark plug (U) of FIG. 10 which is referred to hereinafter.

[Specification of Spark Plug (W)]

In the spark plug (W), the insulator nose length (L) measures 16 mm, and the inner diameter (B) measures 8.7 mm. The base diameter (A) and the spark gap (g) in turn measure 6.36 mm and 1.3 mm with the rear corner of the ledge portion 11 rounded to have 0.3 (1/mm) in terms of curvature R.

[Specification of Spark Plug (U)]

Figure 10:
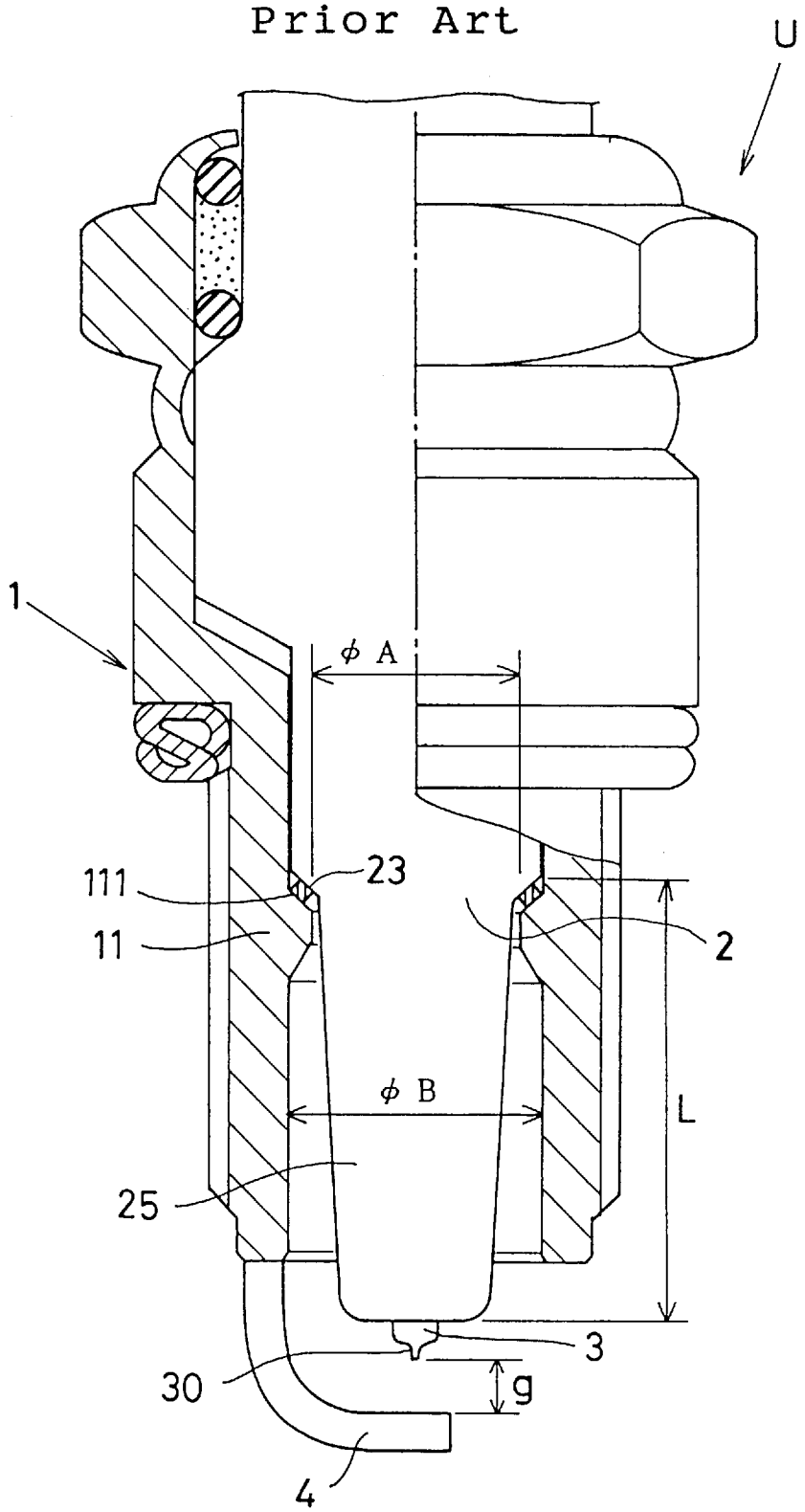
Fig.10 Prior Art
FIG. 10 is a partially sectioned plan view of a main portion of a prior spark plug.

In the prior spark plug (U) of FIG. 10, the insulator nose length (L) measures 16 mm, and the inner diameter (B) measures 8.7 mm. The base diameter (A) and the width dimension of the spark gap (g) in turn measure 7.0 mm and 1.3 mm with the rear corner of the ledge portion 11 not rounded.

According to the third embodiment of the invention, the half clearance {(B-A)/2} is arranged to be 0.9 times of the width dimension of the spark gap (g), it is possible to substantially attain the same advantages as raised at [a]~[e].

It is appreciated that instead of the rear corner of the ledge portion 11, a front corner of the ledge portion 11 may be rounded, otherwise both the front and rear corners may be rounded.

While the invention has been described with reference to the specific embodiments, it is understood that this description is not to be construed in a limitting sense in as much as various modifications and additions to the specific embodiments may be made by skilled artisans without departing the scope of the invention.

What is claimed is:

1. In a spark plug comprising a cylindrical metal shell whose inner wall has a ledge portion, an insulator having a seat portion which engages with a rear slope surface of the ledge portion to be supported within the metal shell, a center electrode supported with an axial bore of the insulator, and a ground electrode extended from the metal shell to form a spark gap with the center electrode:

the spark plug comprising;

a dimensional relationship among (A), (B) and (g) being defined as follows:

$$\{(B-A)/2\} \geqq 0.8 \times (g)$$

where

B (mm) is an inner diameter of a metal shell portion which surrounds an insulator nose, A (mm) is a base diameter of the insulator nose, and g (mm) is a width dimension of the spark gap.

2. A spark plug as recited in claim 1, wherein the dimensional relationship among (A), (B) and (g) is defined as $\{(B-A)/2\} \geqq 0.9 \times (g)$.

3. A spark plug as recited in claim 1 or 2, wherein the width dimension (g) of the spark gap is 1.1 mm or more.

4. A spark plug as recited in claim 1 or 2, wherein the width dimension (g) of the spark gap is 1.3 mm or more.

5. A spark plug as recited in claim 3 wherein a spark gap forming end of the center electrode is thinned, and made of a noble metal based alloy.

6. A spark plug as recited in claim 4 wherein a spark gap forming end of the center electrode is thinned, and made of a noble metal based alloy.

7. A spark plug as recited in claim 3 wherein a length of the insulator nose is 12 mm or more.

8. A spark plug as recited in claim 4 wherein a length of the insulator nose is 12 mm or more.

9. A spark plug as recited in claim 5 wherein a length of the insulator nose is 12 mm or more.

10. A spark plug as recited in claim 6 wherein a length of the insulator nose is 12 mm or more.

11. A spark plug as recited in claim 3 wherein at least one of corner portions of the ledge portion of the metal shell is rounded to have 0.2 (1/mm) or more in terms of curvature (R).

12. A spark plug as recited in claim 4 wherein at least one of corner portions of the ledge portion of the metal shell is rounded to have 0.2 (1/mm) or more in terms of curvature (R).

13. A spark plug as recited in claim 5 wherein at least one of corner portions of the ledge portion of the metal shell is rounded to have 0.2 (1/mm) or more in terms of curvature (R).

14. A spark plug as recited in claim 6 wherein at least one of corner portions of the ledge portion of the metal shell is rounded to have 0.2 (1/mm) or more in terms of curvature (R).

15. A spark plug as recited in claim 7 wherein at least one of corner portions of the ledge portion of the metal shell is rounded to have 0.2 (1/mm) or more in terms of curvature (R).

16. A spark plug as recited in claim 8 wherein at least one of corner portions of the ledge portion of the metal shell is rounded to have 0.2 (1/mm) or more in terms of curvature (R).

17. A spark plug as recited in claim 9 wherein at least one of corner portions of the ledge portion of the metal shell is rounded to have 0.2 (1/mm) or more in terms of curvature (R).

18. A spark plug as recited in claim 10 wherein at least one of corner portions of the ledge portion of the metal shell is rounded to have 0.2 (1/mm) or more in terms of curvature (R).

* * * * *